US007850477B2

(12) United States Patent
Koyama et al.

(10) Patent No.: US 7,850,477 B2
(45) Date of Patent: Dec. 14, 2010

(54) CONNECTOR

(75) Inventors: Ryozo Koyama, Tokyo (JP); Akihiro Kodama, Tokyo (JP); Tadashi Sakaizawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/385,649

(22) Filed: Apr. 15, 2009

(65) Prior Publication Data

US 2009/0286419 A1 Nov. 19, 2009

(30) Foreign Application Priority Data

May 14, 2008 (JP) ..... 2008-127455

(51) Int. Cl.
*H01R 13/627* (2006.01)

(52) U.S. Cl. ..... 439/358

(58) Field of Classification Search ..... 439/358, 439/676, 490, 488, 76.1, 638
See application file for complete search history.

(56) References Cited

U.S. PATENT DOCUMENTS

| | | | | |
|---|---|---|---|---|
| 5,876,239 | A * | 3/1999 | Morin et al. | 439/490 |
| 6,241,550 | B1 * | 6/2001 | Laity et al. | 439/490 |
| 6,863,546 | B2 * | 3/2005 | Yang et al. | 439/79 |
| 7,147,512 | B2 * | 12/2006 | Wu | 439/607.05 |
| 7,413,468 | B1 * | 8/2008 | Little et al. | 439/490 |
| 7,527,523 | B2 * | 5/2009 | Yohn et al. | 439/564 |
| 7,530,818 | B1 * | 5/2009 | Wang | 439/76.1 |
| 7,660,131 | B2 * | 2/2010 | Drouillard et al. | 361/784 |
| 2003/0228788 | A1 * | 12/2003 | Igarashi et al. | 439/358 |
| 2006/0099856 | A1 | 5/2006 | Takei et al. | |

FOREIGN PATENT DOCUMENTS

| | | |
|---|---|---|
| EP | 1274155 | 1/2003 |
| JP | 2002-198117 A | 7/2002 |
| JP | 2003-017165 | 1/2003 |
| JP | 2003-17165 A | 1/2003 |

OTHER PUBLICATIONS

Office Action of Japan Patent Office, Jan. 8, 2010.
European Patent Office Search Report, Apr. 23, 2010.

* cited by examiner

*Primary Examiner*—Jean F Duverne
(74) *Attorney, Agent, or Firm*—Kubotera & Associates LLC

(57) ABSTRACT

A connector is capable of fitting a plurality of mating connectors having various widths. The connector includes a housing including a plurality of fitting openings for receiving the mating connectors and a middle portion disposed between the fitting openings. The middle portion includes a sloped surface facing one of the fitting portions. The connector further includes an abutting portion disposed on the middle portion and protruding into the one of the fitting portions for abutting against one of the mating connectors when the one of the mating connectors is inserted into the one of the fitting portions.

7 Claims, 9 Drawing Sheets

CONNECTOR

BACKGROUND OF THE INVENTION AND RELATED ART STATEMENT

The present invention relates to a connector. More specifically, the present invention relates to a connector capable of fitting a plurality of mating connectors having different widths.

In an electrical device such as a personal computer, a mobile phone, a digital camera, a music player, and the likes, it has been increasingly required to transmit a signal at a high speed. In order to connect such an electrical device, a plug connector compatible with the conventional USB (Universal Serial Bus) standard has been modified to develop a plug connector compatible with a higher standard.

In the plug connector compatible with the higher standard, a high speed shell fitting portion is arranged for high speed transmission, in addition to an ordinary shell fitting portion for fitting a plug connector compatible with a lower standard as well. To this end, a receptacle connector capable of fitting a plurality of mating connectors having different widths has been developed.

Patent Reference has disclosed such a receptacle connector. The receptacle connector includes a first fitting portion for fitting both a plug connector with a narrow width and a plug connector with a wide width. Further, the receptacle connector includes a second fitting portion only for fitting a plug connector with a wide width. According to Patent Reference, the first fitting portion and the second fitting portion are completely divided with a dividing plate. Patent Reference has also disclosed a configuration, in which the first fitting portion and the second fitting portion are not completely divided, and instead a fitting space is narrowed at a middle portion of the connector in a width direction for fitting the plug connector, thereby forming a plurality of fitting portions arranged in series in the width direction.

Patent Reference: Japanese Patent Publication No. 2003-17165

In the conventional electrical connector, in which the first fitting portion and the second fitting portion are not completely divided and the fitting space is narrowed, the plug connector engages with the middle portion in a small area when the plug connector is fitted to the conventional electrical connector, as opposed to the configuration in which the first fitting portion and the second fitting portion are completely divided. In particular, when the plug connector with a narrow width is fitted into the first fitting portion, the plug connector tends to be easily twisted, or the plug connector tends to wobble after the plug connector is fitted into the conventional electrical connector.

In view of the problems described above, an object of the present invention is to provide a connector capable of fitting a plurality of mating connectors (plug connectors) having different widths. In particular, when a plug connector with a narrow width is fitted into a fitting portion capable of fitting both a plug connector with a narrow width and a plug connector with a wide width, it is possible to securely fit the plug connector with a narrow width.

Further objects and advantages of the invention will be apparent from the following description of the invention.

SUMMARY OF THE INVENTION

In order to attain the objects described above, according to the present invention, a connector is capable of fitting a plurality of mating connectors having various widths. The connector includes a fitting opening for fitting the mating connectors, and the fitting opening is narrowed at a middle portion thereof in a width direction thereof, thereby forming a plurality of fitting openings arranged in series in the width direction. The middle portion on a side of one of the fitting openings is provided with a sloped surface. Further, an abutting portion for abutting against the mating connector is disposed on the middle portion on the side of the one of the fitting openings with a size reduced in the width direction.

According to the present invention, the middle portion may include an upright surface facing another of the fitting portions arranged adjacent to the one of the fitting portions.

According to the present invention, the abutting portion may include a surface extending in a direction that the one of the mating connectors is inserted into the one of the fitting portions.

According to the present invention, the sloped surface may be formed of a metal plate, and the abutting portion is formed of a cut portion formed in the metal plate. Further, the abutting portion may be formed on a side surface of the metal plate.

According to the present invention, the metal plate may be joined along a joint line situated in the one of the fitting openings and extending in a direction that the one of the mating connectors is inserted into the one of the fitting portions, which may be less likely to be twisted.

In the present invention, it is possible to provide the connector capable of securely fitting the mating connectors having various widths.

DETAILED DESCRIPTION OF THE PREFERRED EMBODIMENTS

Hereunder, embodiments of the present invention will be explained with reference to the accompanying drawings.

Figure 1:
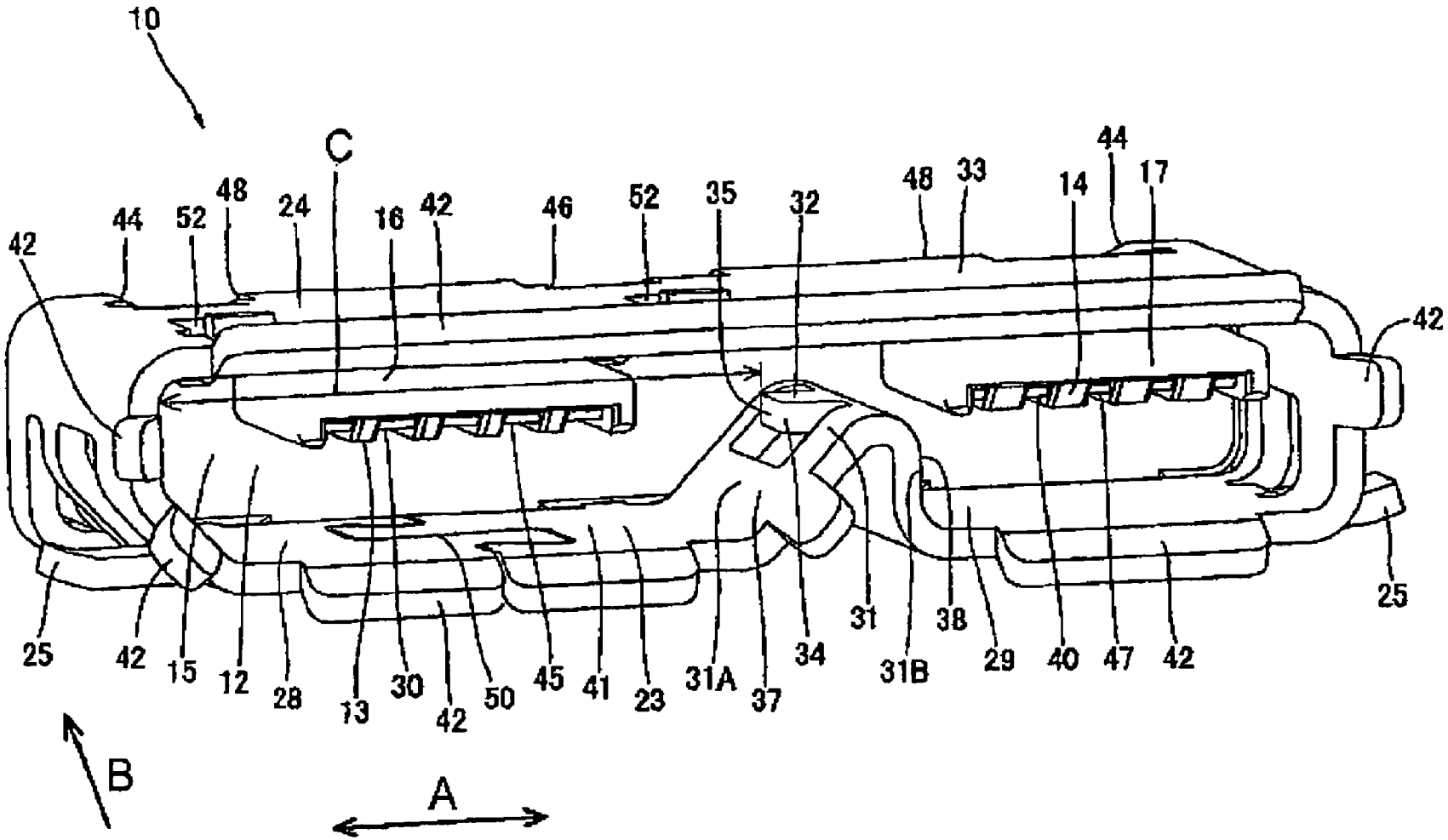
FIG. 1 is a perspective view showing a connector according to an embodiment of the present invention.
Figure 2:
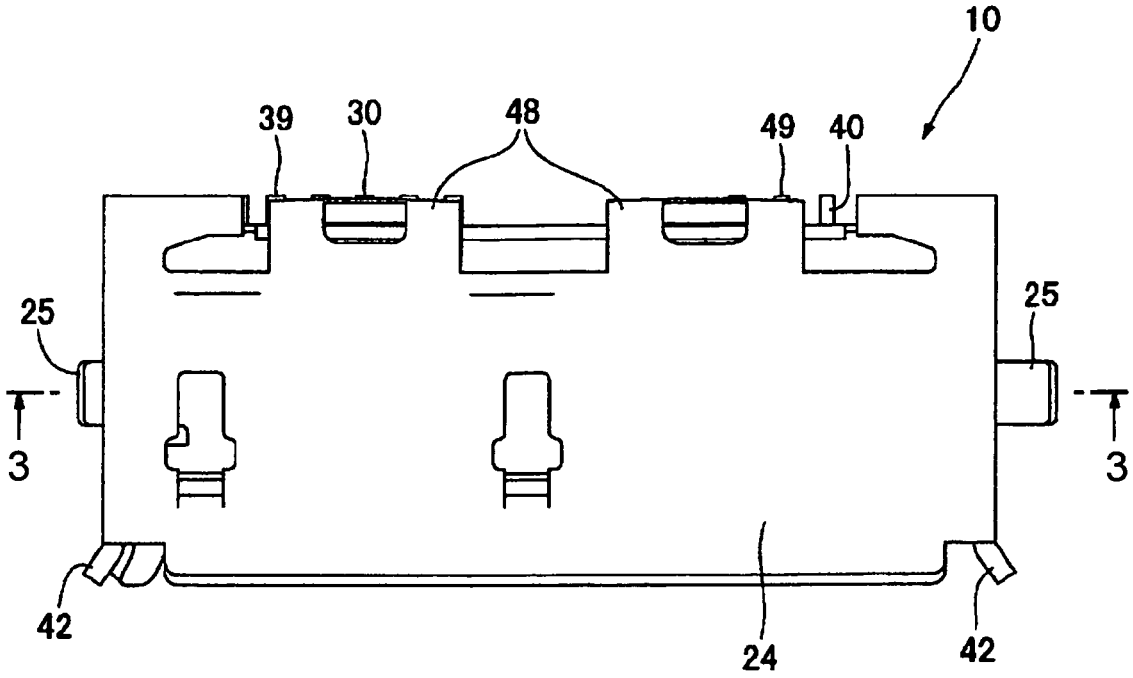
FIG. 2 is a plan view showing the connector according to the embodiment of the present invention.
Figure 3:
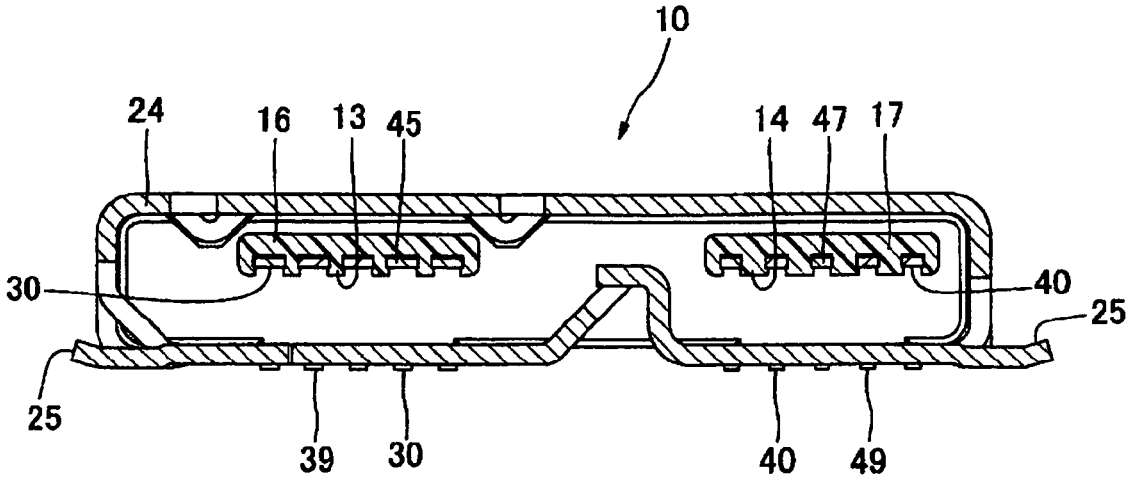
FIG. 3 is a partially sectional view showing the connector taken along a line 3-3 in FIG. 2 according to the embodiment of the present invention.

FIG. 1 is a perspective view showing a connector 10 according to the embodiment of the present invention. FIG. 2 is a plan view showing the connector 10. FIG. 3 is a sectional view showing the connector 10 taken along a line 3-3 in FIG. 2 according to the embodiment of the present invention.

As shown in FIG. 1, the connector 10 includes an insulating housing 12 formed by molding a resin; a metal shell 24 surrounding an outside of the insulating housing 12 like a tube; and a plurality of terminals 30 and 40 integrally formed with the insulating housing 12.

The connector 10 has a plurality of consecutive fitting portions arranged next to each other in order to connect a plurality of mating connectors with different widths. In the embodiment, the connector 10 has two fitting portions 28 and 29. The fitting portions 28 and 29 may include a guiding portion 42 at an opening 23 thereof for easily guiding the mating connectors.

The insulating housing 12 includes a base end portion 15 forming a rear portion of the connector 10 and holding portions 16 and 17. The holding portions 16 and 17 extend from the base end portion 15 toward the opening 23 having a space against an inner surface of a top panel 33 of the metal shell 24. The two holding portions 16 and 17 correspond to the two fitting portions 28 and 29, respectively.

The terminals 30 and 40 are aligned in the base end portion 15 and the holding portions 16 and 17 in a connecting direction of the mating connectors with a narrow pitch, respectively. The terminals 30 and 40 include front end portions 45 and 47, respectively. Portions near the front end portions 45 and 47 of the terminals 30 and 40 are partially exposed at a lower side of the holding portions 16 and 17. The terminals 30 and 40 can contact with terminals of the mating connectors through the exposed portions thereof.

The terminal 30 and 40 also include rear end portions 39 and 49, respectively. Portions near the rear end portions 39 and 49 of the terminals 30 and 40 are partially exposed at the base end portion 15 of the insulating housing 12 in order to solder a corresponding portion of a base board thereto together with a soldering portion 25 of the metal shell 24. The holding portions 16 and 17 may include terminal aligning portions 13 and 14 having a groove extending in the connecting direction of the mating connectors for situating the terminals 30 and 40, respectively.

The metal shell 24 may be formed of a metal plate. For example, the metal shell 24 is formed from the metal plate punched into a given shape then bent into a tube-like shape. The metal shell 24 can be fixed to the insulating housing 12 after inserting the insulating housing 12 from a rear end, that is, an opposite side of a side where the opening 23 is located thereof. It is possible to fix the metal shell 24 to the insulating housing 12 with engaging tongue pieces 44 and 46 or a rear supporting plate 48 (shown in FIG. 6, described later) by riveting, press fitting or bending.

Figure 4:
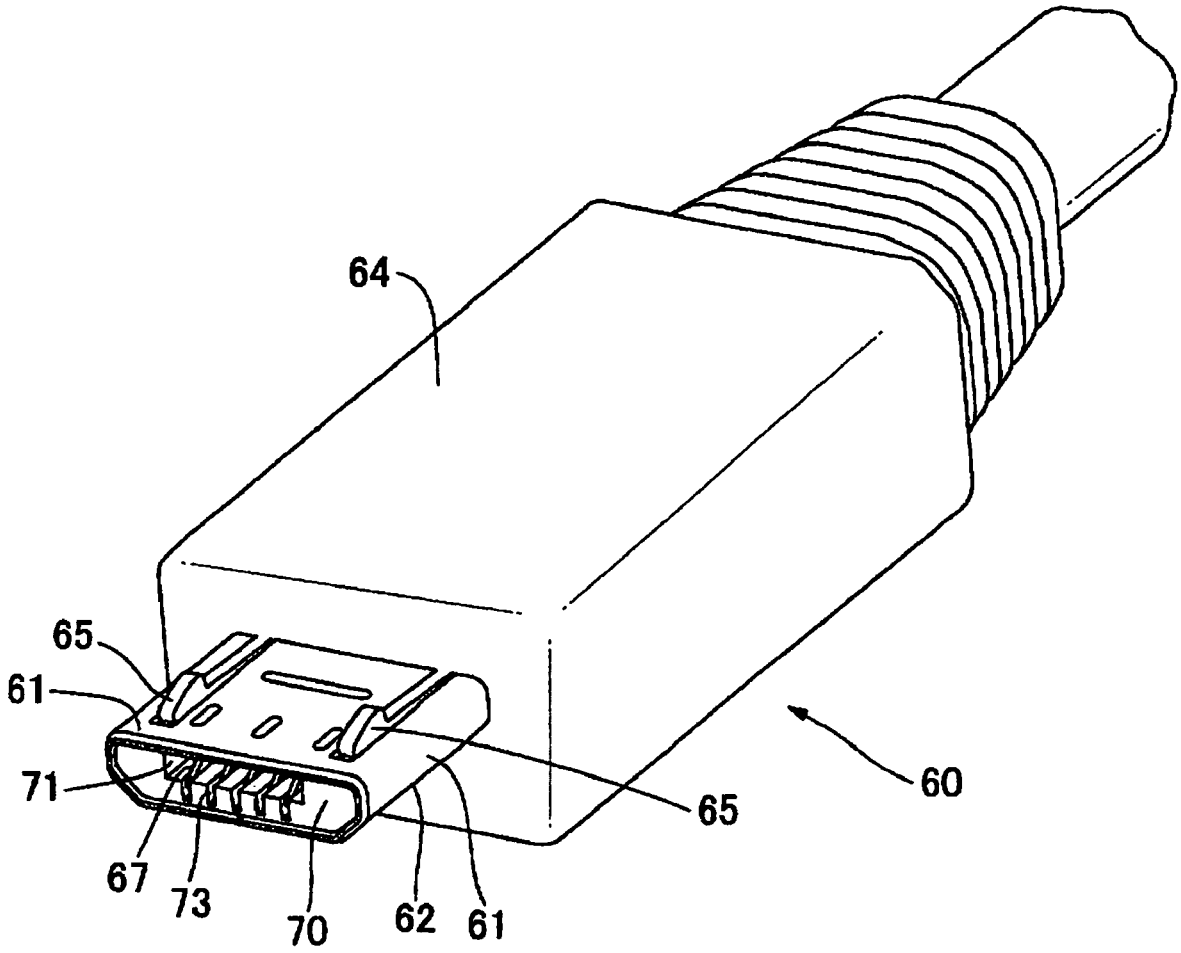
FIG. 4 is a perspective view showing a plug connector with a narrow width capable of fitting to the connector according to the embodiment of the present invention.
Figure 5:
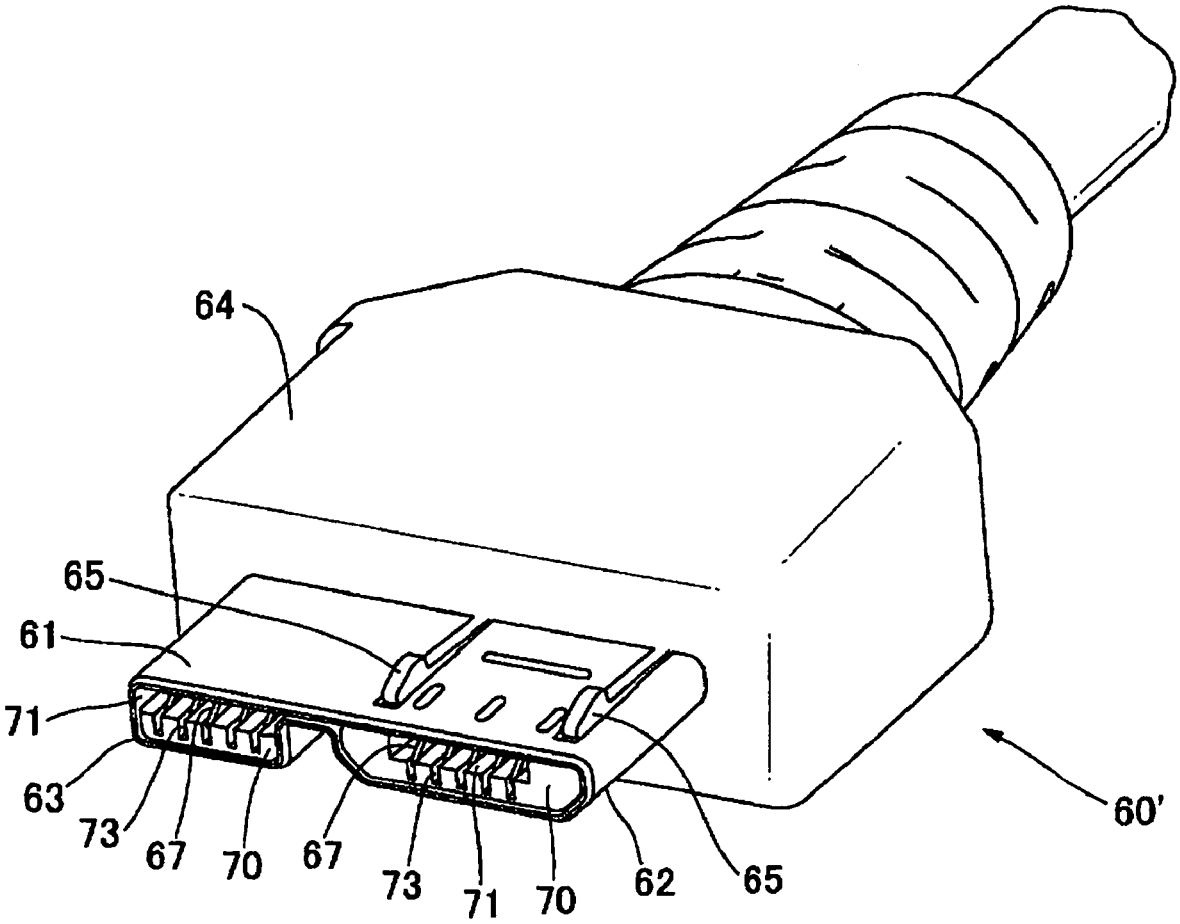
FIG. 5 is a perspective view showing another plug connector with a wide width capable of fitting to the connector according to the embodiment of the present invention.

FIGS. 4 and 5 are perspective views showing examples of the mating connectors capable of connecting to the connector 10 according to the embodiment of the present invention. In FIG. 4, a mating connector 60 is capable of connecting to only the fitting portion 28, while a mating connector 60' shown in FIG. 5 is capable of connecting to both of the fitting portions 28 and 29.

Each of the mating connectors 60 and 60' includes an insulating housing 70 formed by molding a resin; a metal shell 61 surrounding an outside of the insulating housing 70; a resin 64 fixing the insulating housing 70 and a shell fitting portion 62 of the metal shell 61 in a state of being exposed partially; an engaging protrusion 65 capable of an elastic deformation located at the shell fitting portion 62; and a terminal 67 aligned in a terminal aligning portion 73 of the insulating housing 70. The insulating housing 70 and the metal shell 61 can form a fitting hole 71 for receiving the holding portions 16 and 17 of the connector 10 when the connector 10 is connected thereto.

The mating connector 60' shown in FIG. 5 includes a high-speed shell fitting portion 63 capable of high-speed transmission, in addition to the shell fitting portion 62, which the mating connector 60 in FIG. 4 includes as well. In other words, a width of the mating connector 60' in FIG. 5 is relatively wider while the width of the mating connector 60 in FIG. 4 is relatively narrower. The high-speed shell fitting portion 63 shown in FIG. 5 is used for high-speed transmission while the shell fitting portion 62 is used for ordinary-speed transmission. In addition to the functional difference described above, the high-speed shell fitting portion 63 has a cross-sectional surface of an approximate rectangular shape while the shell fitting portion 62 has a cross-sectional surface of an approximate upside-down trapezoidal shape.

Figure 6:
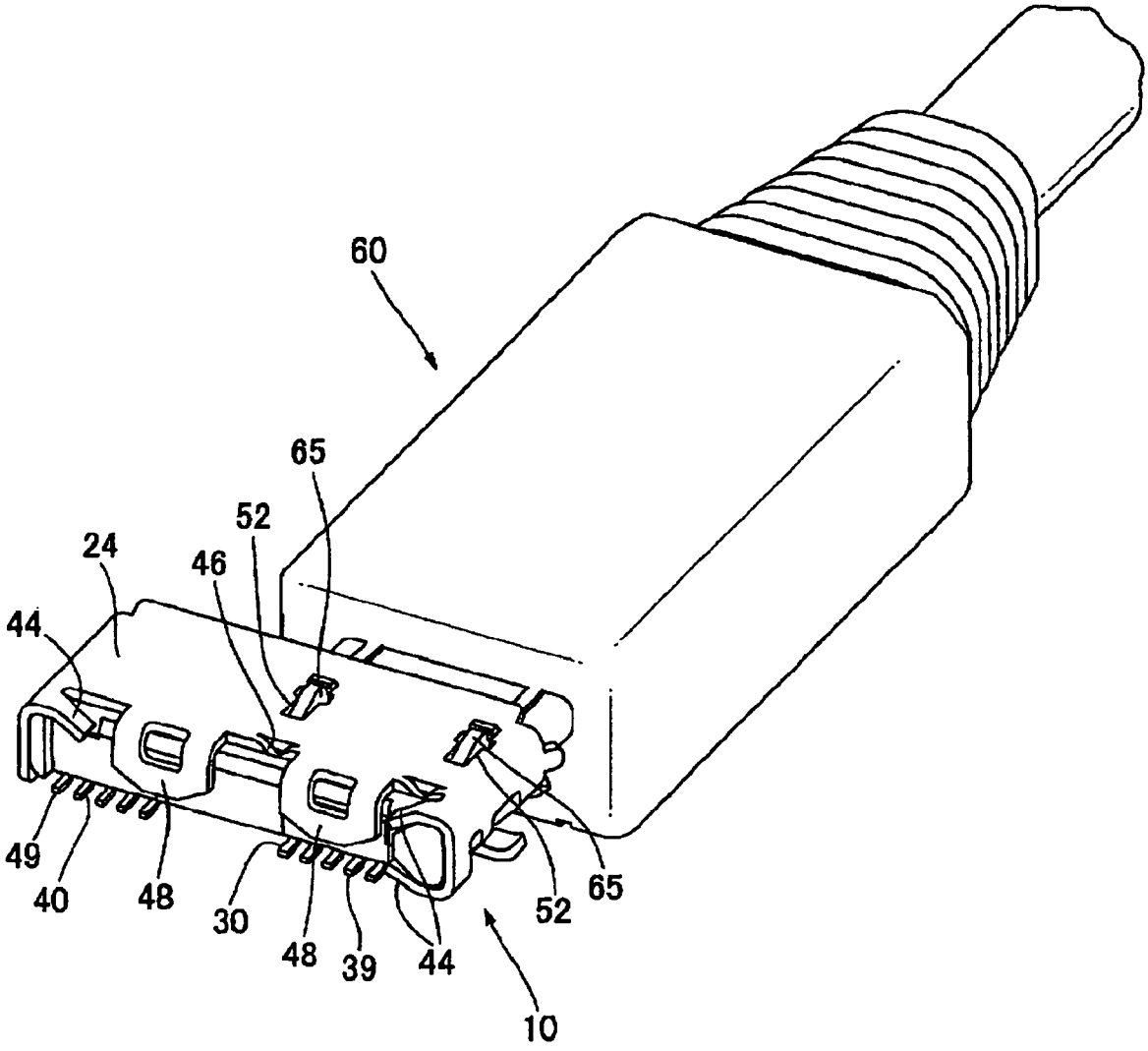
FIG. 6 is a perspective view showing the plug connector shown in FIG. 4 and fitted to the connector according to the embodiment of the present invention.
Figure 7:
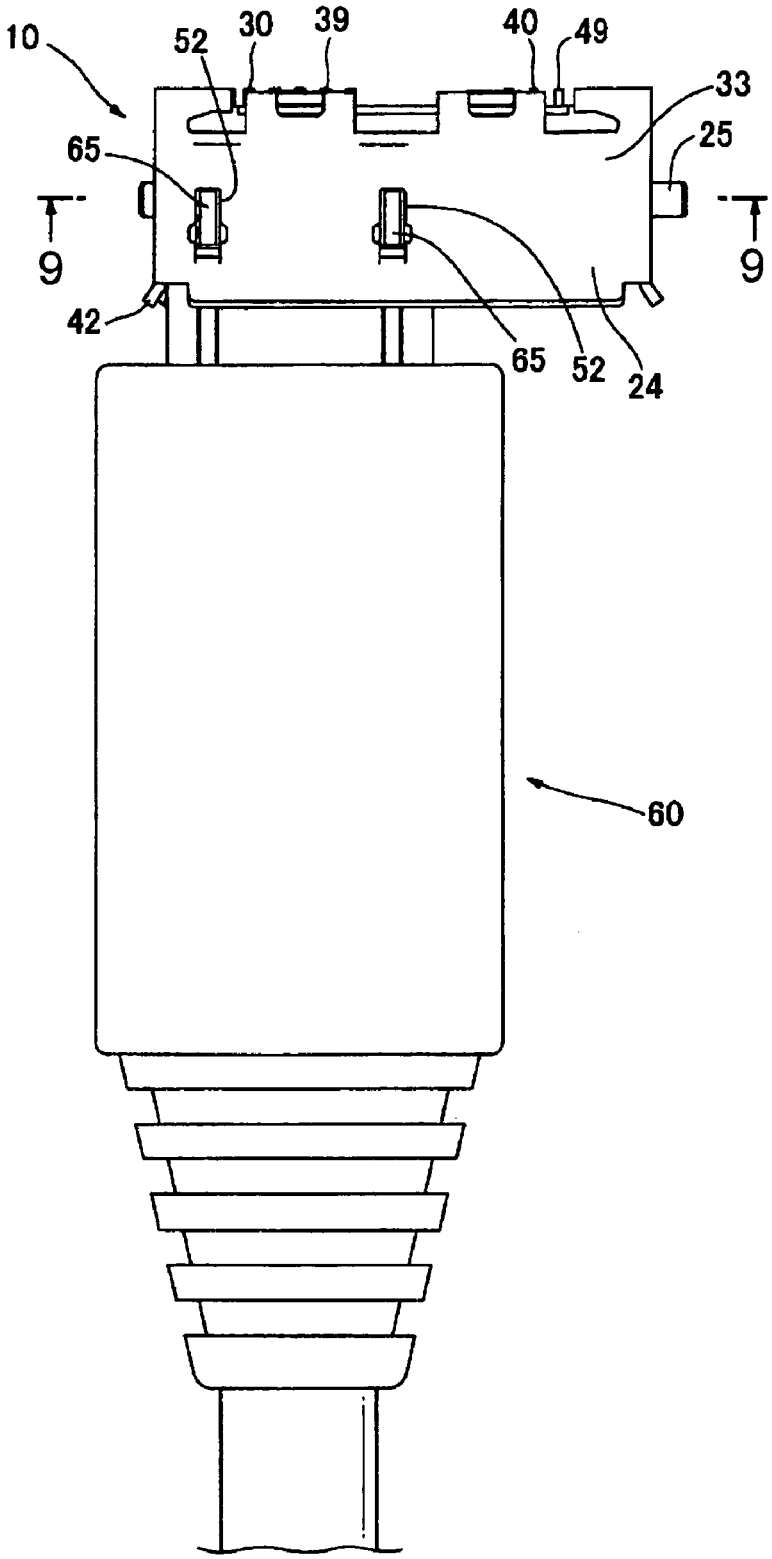
FIG. 7 is a plan view showing the plug connector shown in FIG. 4 and fitted to the connector according to the embodiment of the present invention.
Figure 8:
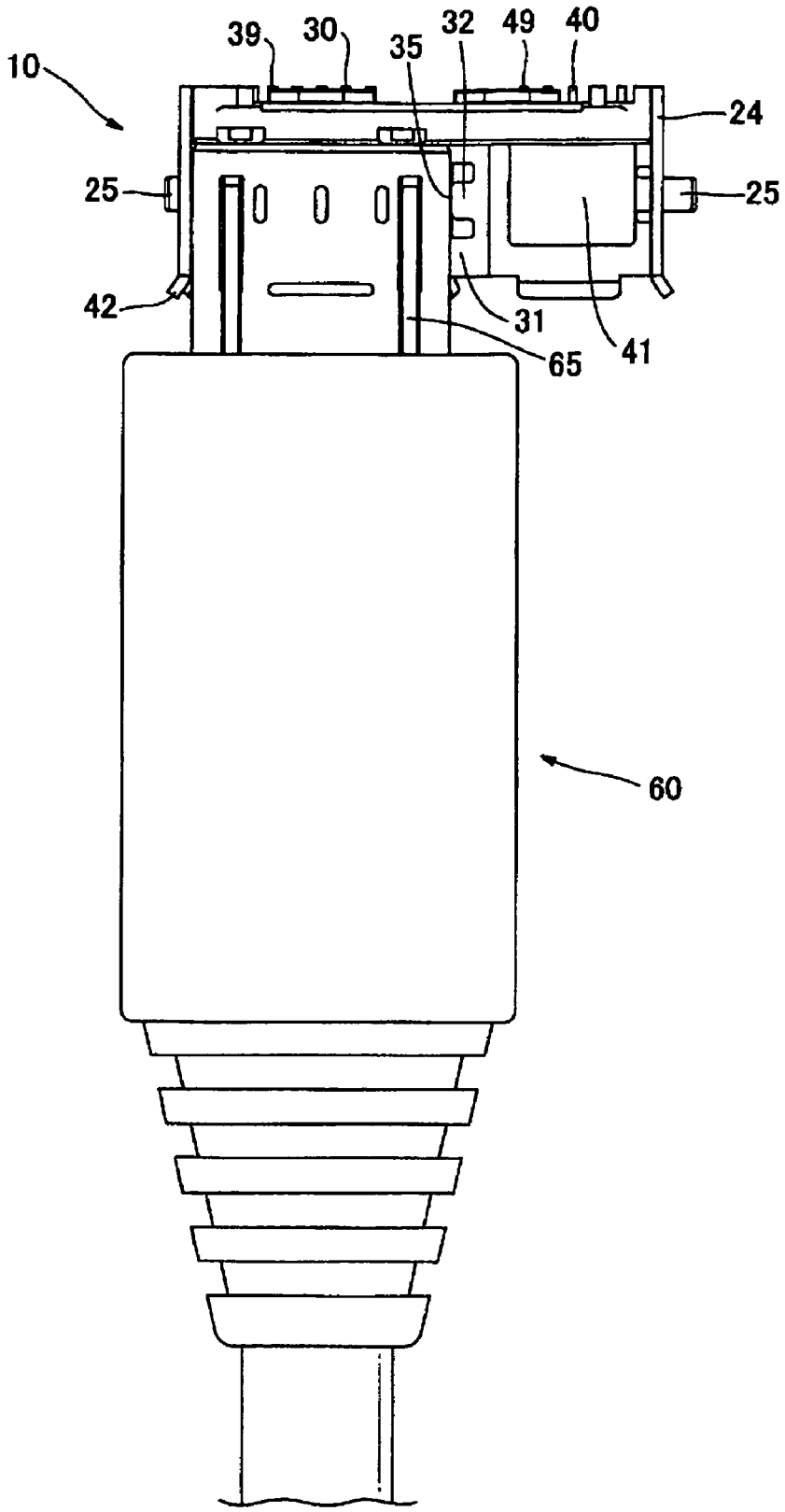
FIG. 8 is another plan view showing the plug connector shown in FIG. 4 and fitted to the connector according to the embodiment of the present invention.
Figure 9:
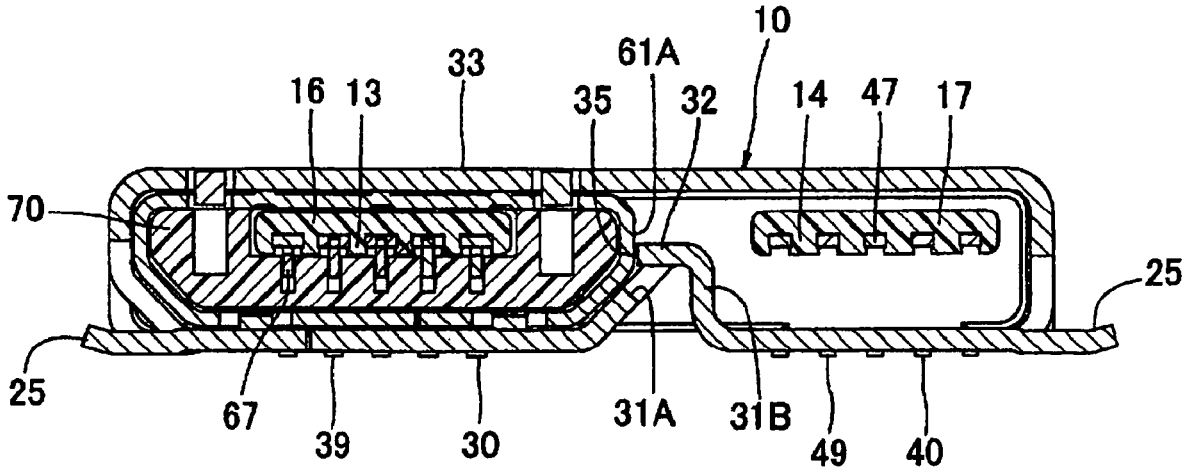
FIG. 9 is a sectional view showing the connector taken along a line 9-9 in FIG. 7 according to the embodiment of the present invention.

FIGS. 6 to 9 show the connector 10 shown in FIGS. 1 to 3, in a state of connecting to the mating connector 60 having the narrower width shown in FIG. 4. FIG. 6 is a perspective view of the connector 10 when the connector 10 is connected to the mating connector 60 as described above; FIG. 7 is a plan view thereof; FIG. 8 is a plan view omitting the top panel 33 for the purpose of showing a state of an inside of the connector 10; and FIG. 9 is a sectional view taken along a line 9-9 in FIG. 7.

As shown in FIGS. 6 to 9, a tip portion of the shell fitting portion 62 is inserted into the fitting portion 28 through the opening 23 of the connector 10 when the connector 10 is connected to the mating connector 60. In addition, when the connector 10 is connected to the mating connector 60', the tip portion of the shell fitting portion 62 is inserted into the fitting portion 28 through the opening 23 of the connector 10 while a tip portion of the high-speed shell fitting portion 63 is inserted into the fitting portion 29 through the opening 23 of the connector 10 (not shown). Accordingly, the connector 10 is capable of connecting both of the mating connectors 60 and 60' having the different widths from each other since the connector 10 includes a plurality (two in the embodiment) of consecutive fitting portions 28 and 29.

When the tip portion of the shell fitting portion 62 is inserted, an engaging protrusion 65 provided in the shell fitting portion 62 engages with an engaging hole 52 provided at the top panel 33 of the connector 10. The connector 10 can engage with the mating connector 60 or 60' by the engagement of the engaging protrusion 65 and the engaging hole 52. Further, when the connector 10 is connected to the mating connector 60 or 60', the holding portions 16 and 17 are inserted into the fitting hole 71 of the mating connector 60 or 60'. As a result, the terminal 67 of the mating connector 60 or 60' can contact the corresponding terminals 30 or 30 and 40 of the connector 10, respectively.

A fitting opening 41 is opened for fitting the mating connector 60 or 60' and the fitting portions 28 and 29 are formed by narrowing the fitting opening 41 along a fitting direction (a direction of an arrow B) at a middle portion 31 in a width direction (a direction of an arrow A) thereof. The fitting portions 28 and 29 are formed by only narrowing the fitting opening 41, not by dividing the fitting opening 41 separated completely. Accordingly, the fitting portions 28 and 29 can be formed as consecutive fitting portions lying next to each other in the width direction (a direction of the arrow A).

In the embodiment, for example, the fitting portions 28 and 29 are formed of the metal shell 24 bent in forms corresponding to the cross-sectional surface of an approximate upside-down trapezoidal shape of the shell fitting portion 62 and the cross-sectional surface of an approximate rectangular shape of the high-speed shell fitting portion 63. More specifically, the fitting portions 28 and 29 are formed with a middle portion 31A located on a side of the fitting portion 28 as a sloped surface 37 and a middle portion 31B located on a side of the fitting portion 29 as an upright surface 38.

When the fitting portions 28 and 29 are formed as described above, as compare to a case that the fitting portions 28 and 29 are divided completely, the middle portion 31 can have a smaller interfering surface interfering with the mating connector 60 or 60' as the mating connector 60 or 60' is connected. Consequently, the mating connector 60 may be twisted when the mating connector 60 with the narrower width is inserted or may be deformed after the mating connector 60 is connected. Particularly, when the middle portion has a slope, as the sloped surface 37 of the middle portion 31A, it is necessary to strengthen the middle portion when the mating connector 60 is twisted, particularly in a right direction (a direction of an arrow C).

In order to meet the necessity described above, in the embodiment, the connector 10 includes an abutting portion 35 capable of abutting against the mating connector 60 on the middle portion 31A on the side of the fitting portion 28 thereof. As shown in FIG. 1, the abutting portion 35 is formed by narrowing the fitting portion 28 in the width direction of the fitting opening 41 (a direction of the arrow A), to a width shown as C in FIG. 1. When the mating connector 60 is connected to the connector 10, that is, when the mating connector 60 having the narrower width is inserted to the fitting portion 28, the abutting portion 35 abuts against the mating connector 60 as the mating connector 60 is twisted, thereby regulating a movement of the mating connector 60 toward the fitting portion 29. Accordingly, with the abutting portion 35 described above, it is possible to connect the mating connector 60 more securely.

More specifically, the abutting portion 35 can be formed of a portion of the middle portion 31A on the side of the fitting portion 28. In other words, the abutting portion 35 can be formed of the sloped surface 37 of the metal shell 24 cut and bent upward so as to be parallel with the width direction (a direction of the arrow A). In this case, it is preferable that the abutting portion 35 is made as a plane along the fitting direction (a direction of the arrow B) so that the abutting portion 35 can abut against the mating connector 60 or 60' more certainly.

Further, it is possible to increase rigidity of the abutting portion 35 by forming the abutting portion 35 with a thickness portion of the metal plate of the metal shell 24. Moreover, it is preferable that the abutting portion 35 is chamfered at corners thereof, at least the corners located a connecting side so that the mating connector 60 or 60' can abut against the abutting portion more smoothly. A curved surface 34 is formed by chamfering the abutting portion 35 at the corners thereof. In addition, it is preferred that a surface of the abutting portion 35 is arranged so as to face a side surface 61A (shown in FIG. 9) of the mating connector 60 extending in an upright direction.

On the other hand, the middle portion 31B located on a side of the fitting portion 29 is formed as the upright surface 38 corresponding to the cross-sectional surface of the high-speed shell fitting portion 63 having the approximate rectangular shape. Therefore, the problems described above hardly occur. It is obvious that the middle portion 31B located on a side of the fitting portion 29 may have an abutting portion similar to the abutting portion 35 though the problems hardly occur.

Figure 10:
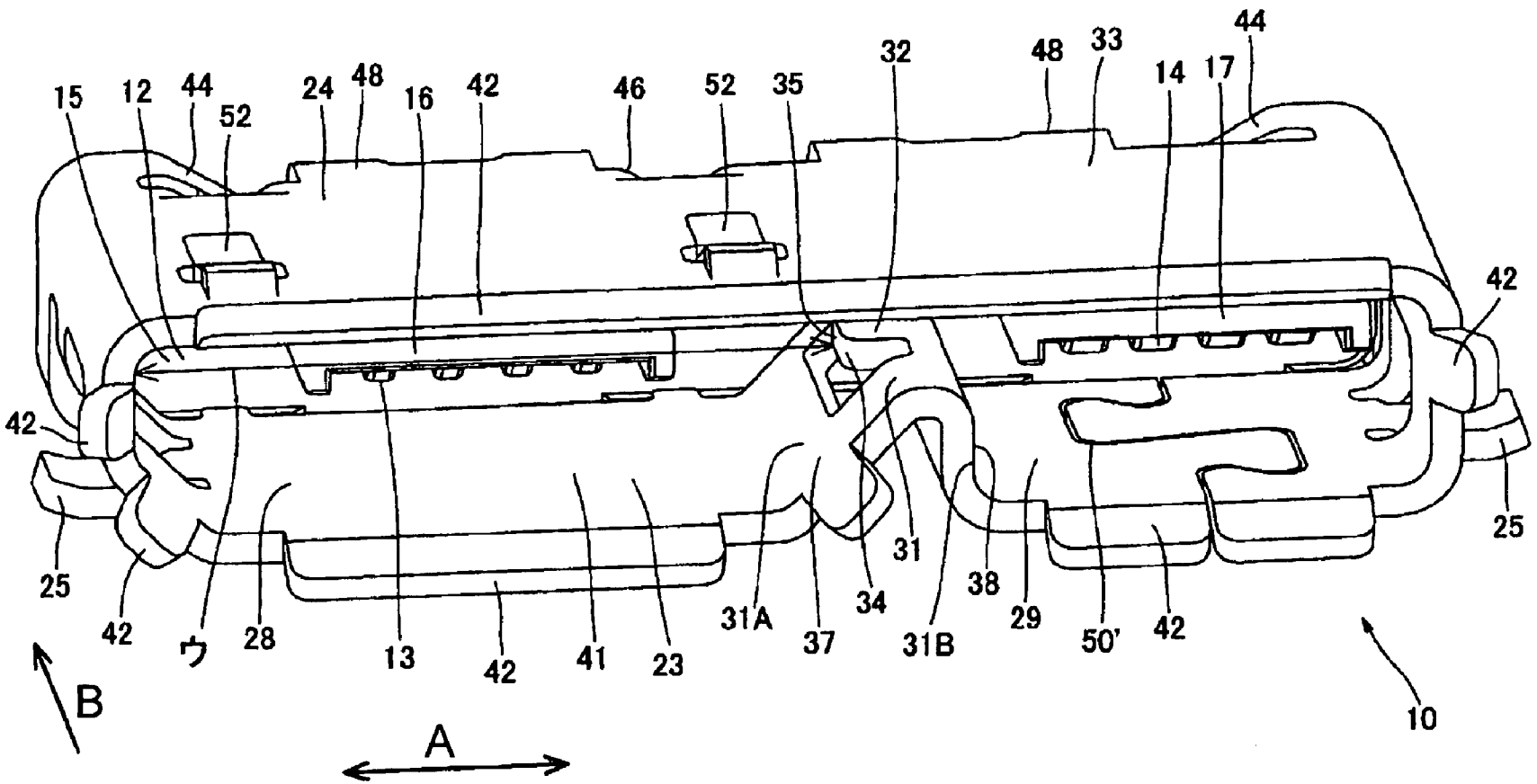
FIG. 10 is a perspective view showing a modified example of the connector according to the embodiment of the present invention.

With reference to FIG. 10, one of variations of the present invention will be explained. When the fitting portions 28 and 29 are formed of the metal plate bent into the tube-like shape, joints 50 and 50' having a complimentary shape are formed as shown in FIGS. 1 and 10, respectively. It is preferable that the joint 50 or 50' extends along the connecting direction (a direction of an arrow B) of the mating connector 60 (60') in order to reduce a force applied as the mating connector 60 (60') is connected.

It is also preferable that the joint is provided in a side of the fitting portion 29 as shown in FIG. 10. When the joint is provided in a side of the fitting portion 29, the connector 10 is less likely to be deformed as compared to a case that the joint is provided in a side of the fitting portion 28. As shown in FIG. 1, when the joint 50 is provided in a side of the fitting portion 28, the connector 10 is more likely to be deformed by the mating connector 60 connected only to the fitting portion 28.

The connector in the present invention is not limited to an electrical connector though being explained as an electrical connector in the embodiment described above. The present invention can be applied to not only an electrical connector but also every kind of connector such as an optical connector and so on. Therefore, the present invention relates to every kind of connector, not limited to an electrical connector.

The disclosure of Japanese Patent Application No. 2008-127455, filed on May 14, 2008 is incorporated in the application by reference.

While the invention has been explained with reference to the specific embodiments of the invention, the explanation is illustrative and the invention is limited only by the appended claims.

What is claimed is:

1. A connector capable of fitting a plurality of mating connectors having various widths, comprising:

a housing including a plurality of fitting portions for receiving the mating connectors and a middle portion disposed between the fitting portions, each of said fitting portions being connected and communicated with each other to form one single fitting opening, said middle portion including a sloped surface facing one of the fitting portions; and an abutting portion disposed on the middle portion and protruding into the one of the fitting portions for abutting against one of the mating connectors when the one of the mating connectors is inserted into the one of the fitting portions.

2. The connector according to claim 1, wherein said fitting openings are arranged next to each other along a width direction of the connector to communicate with each other.

3. The connector according to claim 1, wherein said middle portion further includes an upright surface facing another of the fitting portions arranged adjacent to the one of the fitting portions.

4. The connector according to claim 1, wherein said abutting portion includes a surface extending in a direction that the one of the mating connectors is inserted into the one of the fitting portions.

5. The connector according to claim 1, wherein said sloped surface is formed of a metal plate, said abutting portion being formed of a cut portion formed in the metal plate.

6. The connector according to claim 5, wherein said abutting portion is formed on a side surface of the metal plate.

7. The connector according to claim 1, wherein said metal plate is joined along a joint line situated in the one of the fitting portions and extending in a direction that the one of the mating connectors is inserted into the one of the fitting portions.

* * * * *